US005088168A

United States Patent [19]

Berger et al.

[11] Patent Number: 5,088,168

[45] Date of Patent: Feb. 18, 1992

[54] YARN TEXTURING APPARATUS WITH HEAT SENSOR IN STUFFER BOX TO CONTROL HEAT FLOW

[75] Inventors: Hans-Peter Berger, Remscheid; Klaus Burkhardt, Schwelm; Klaus Gerhards, Huckeswagen; Hans-Peter Eck, Wipperfurth, all of Fed. Rep. of Germany

[73] Assignee: Barmag AG, Remscheid, Fed. Rep. of Germany

[21] Appl. No.: 612,071

[22] Filed: Nov. 13, 1990

[30] Foreign Application Priority Data

Nov. 11, 1989 [DE] Fed. Rep. of Germany ..... 3937664
Apr. 25, 1990 [DE] Fed. Rep. of Germany ..... 4013104

[51] Int. Cl.[5] ..... D02G 1/00; D02J 1/00

[52] U.S. Cl. ..... 28/249; 28/267; 28/263; 28/248

[58] Field of Search ..... 28/263, 236, 249, 267, 28/248

[56] References Cited

U.S. PATENT DOCUMENTS

| | | | |
|---|---|---|---|
| 3,751,778 | 8/1973 | Grosjean et al. | 28/267 X |
| 3,936,917 | 2/1976 | Vermeer et al. | 28/263 X |
| 3,961,402 | 6/1976 | Ferrier et al. | 28/72.14 |
| 3,965,548 | 6/1976 | James | 28/267 X |
| 4,118,843 | 10/1978 | Schippers et al. | 28/255 |
| 4,369,555 | 1/1983 | Nikkel | 28/221 |
| 4,691,947 | 9/1987 | Burkhardt et al. | 28/255 |
| 4,724,588 | 2/1988 | Runkel | 28/255 |
| 4,796,340 | 1/1989 | Gerhards | 28/248 |
| 4,829,640 | 5/1989 | Greb et al. | 28/253 |
| 4,956,901 | 9/1990 | Koskol et al. | 28/267 X |
| 4,999,890 | 3/1991 | Nabulon | 28/249 X |

FOREIGN PATENT DOCUMENTS

| | | | |
|---|---|---|---|
| 1392158 | 4/1988 | U.S.S.R. | 28/249 |

*Primary Examiner*—Werner H. Schroeder
*Assistant Examiner*—Bibhu Mohanty
*Attorney, Agent, or Firm*—Bell, Seltzer, Park & Gibson

[57] ABSTRACT

A yarn texturing apparatus is disclosed which includes a nozzle having a yarn duct therethrough, and a perforated stuffer box at the outlet end of the duct. Heated air is introduced into the duct, and the air is heated by a heater which is positioned in the air supply line leading to the nozzle. The output of the heater is controlled by a temperature sensor which is positioned inside the stuffer box. Also, the nozzle comprises two confronting sections which can be separated to facilitate yarn thread-up, and a valve is provided in the supply line to divert the heated air to an exhaust line when the nozzle is opened. A second temperature sensor is positioned in the supply line and is operative when the nozzle is opened to regulate the output of the heater and avoid large fluctuations of its output. In a further embodiment, the heater is controlled by a circuit which stores the signal from the temperature sensor in the stuffer box, and this stored signal is utilized to control the heater when the nozzle is opened.

20 Claims, 4 Drawing Sheets

YARN TEXTURING APPARATUS WITH HEAT SENSOR IN STUFFER BOX TO CONTROL HEAT FLOW

BACKGROUND OF THE INVENTION

The present invention relates to an apparatus for texturing a synthetic yarn.

Yarn nozzles are known from German DE-C 36 34 749 and corresponding to U.S. Pat. No. 4,796,340 and wherein the yarn nozzle is provided with a yarn duct which is supplied with hot air and terminates in an expansion chamber which has a larger cross section than the yarn duct. The expansion chamber possesses lateral outlets, for example axially extending slots, and is therefore connected with the atmosphere. The hot air which is supplied into the yarn duct expands with the yarn in the expansion chamber. Consequently, the multifilament yarn is expanded in the expansion chamber and compressed to a yarn plug thereby being deformed. This yarn plug is further advanced by the pressure in the expansion chamber, then deposited after leaving the expansion chamber on a slowly rotating cooling drum, and finally disentangled to a crimped yarn, note also DE-C 26 32 082 and corresponding to U.S. Pat. No. 4,118,843.

In the above nozzles, the hot air is generated in a heater. To regulate the process, the temperature of the hot air is measured in the supply line to the nozzle, and as a function of this measured value and a desired temperature, the regulator for the heater is controlled such that the temperature remains constant.

It has been found that in the above described method, the point of disentanglement at which the yarn plug unravels again to a textured yarn, may move along the cooling drum, without it being possible to notice and detect the process parameters which cause this instability.

It is accordingly an object of the present invention to provide a yarn nozzle of the described type and wherein a stability of the texturing process is ensured, in particular that the point of disentanglement is prevented from shifting.

It is also an object of the present invention to provide a yarn nozzle of the described type and which comprises two sections which are separated or opened to facilitate yarn thread-up, and wherein large fluctuations of the output of the heater are avoided when the nozzle is opened, and so that the temperature in the air supply line to the nozzle can be maintained relatively constant during opening.

SUMMARY OF THE INVENTION

The above and other objects and advantages of the present invention are achieved in the embodiments illustrated herein by the provision of a yarn texturing apparatus which comprises a nozzle including a duct through which the yarn is adapted to advance at high speed from an inlet end to an outlet end, passageway means for conducting a pressurized heating fluid into the duct during operation of the apparatus, and a perforated stuffer box disposed adjacent the outlet end of the yarn duct for receiving and forming a compressed plug from the advancing yarn exiting from the duct. Heating means is also provided which includes a temperature sensor disposed in the stuffer box for maintaining the temperature of the heating fluid at a predetermined level.

The present invention deviates from the widely held view that the highest temperature of the heated gaseous medium to which the yarn is subjected, determines the texturing result. Rather, the present invention takes deliberately into account that the temperature in the texturing nozzle is not proportional to the highest temperature of the heated gaseous medium. To this end, it should be noted that the temperature of the heated gaseous medium in the nozzle varies unsteadily as a result of the expansion. It has been shown that this determination of the temperature permits an excellent long-term stability of the texturing process and texturing quality to be achieved. Decisive therefor should be the fact that along with the temperature of the hot air in the expansion chamber also the air pressure in the expansion chamber, which compresses the yarn plug formed therein and pushes the same out of the expansion chamber, is influenced at the same time, and that consequently a self-regulating effect develops with regard to temperature and pressure.

The known yarn nozzle is designed and constructed such that it is possible to open the yarn duct and the expansion chamber along their entire length. This allows an advancing yarn to be inserted laterally into the yarn duct or expansion chamber respectively. A suitable embodiment of such a texturing nozzle is shown, for example, in EP-A 256,448 and U.S. Pat. No. 4,829,640. There, the yarn nozzle is divided in the longitudinal plane of the yarn duct, so that one half thereof can be opened relative to the other half about an axis parallel to the yarn duct.

A further problem associated with nozzles of this described type is the fact that the temperature in the expansion chamber drops drastically when the nozzle is opened. Consequently, the regulator for the air heater will increase the energy input in the meaning of raising the temperature and, thus, move the heater far out of its operating range.

It is impossible to prevent this negative result by the measure disclosed in DE-C 36 34 749, and U.S. Pat. No. 4,796,340, according to which the throughput of the air volume is kept constant, when the yarn nozzle is opened. Rather, it is necessary to stop the automatic regulation of the air heater. Thus, after the yarn thread-up, a long time will be needed until stable temperature conditions return.

In accordance with one embodiment of the present invention, the above problem is solved by the provision of a second temperature sensor which is positioned in the supply line between the heater and the yarn nozzle, in addition to the temperature sensor positioned in the expansion chamber. It is also possible to apply the measure known from DE-C 36 34 749 and U.S. Pat. No. 4,796,340 so that the throughput of the air volume through the heater is kept constant while the texturing nozzle is open.

In a further embodiment of the present invention, the measure known from DE-C 36 34 749 and U.S Pat. No. 4,796,340 is supplemented in that the heater control means, which includes a heater regulator for the heater of the heating medium, is controlled during the opening of the nozzle, and such that the heater regulator is operated in the control position which resulted before in the stationary operation of the yarn nozzle, and which is then definitely input, without a change, when the nozzle is opened. As a result, it is ensured that the volume of air or vapor, which remains constant, is continued to be heated with the same amount of energy and, accordingly, is continued to be heated to the temperature maintained during the operation. It should be noted that this method is useful and applicable, regardless whether the temperature sensor is arranged in the expansion chamber of the yarn nozzle or, as has been usual in the past, in the supply line for the heating medium between the heater and the yarn nozzle.

In the method of DE-C 36 34 749, and U.S. Pat. No. 4,796,340, the air flow supplied to the heater is throttled when the nozzle is opened. This measure serves to keep the throughput of the volume in the heater constant. However, this measure will not avoid having hot air continue to exit in the nozzle, which interferes with the servicing. In accordance with a further feature of the present invention, a valve is preferably positioned in the supply line between the second temperature sensor and the nozzle, and the valve is movable between a first position wherein the supply line is open to the nozzle, and a second position wherein the supply is open to an exhaust line. The valve is switched preferably by the device which unlocks and opens the texturing nozzle. This opening device also allows to switch the heater regulator from the first temperature sensor in the expansion chamber to a second temperature sensor in the supply line. However, as an alternative, it is also possible to switch the valve along with the following measure for switching the heater regulator.

The measures for switching the heater regulator from the first temperature sensor in the expansion chamber to the second temperature sensor in the supply line, which are described below, have the advantage that they allow to avoid large fluctuations in the energy supply to the heater of the gaseous medium. In general, the solution provides that the temperature conditions in the supply line can be kept constant. To this end, it is possible to make use of the temperature jump of the first temperature sensor, which occurs when the yarn nozzle is opened. However, it is also possible to solve the problem of effecting an automatic switchover, by monitoring the temperature difference between the indicated temperatures of the first and second sensors. This has the advantage that a very close relation exists between the operating temperature of the yarn nozzle and the operating temperature of the supply line at the time of the switchover. This relation is predetermined by the allowed temperature difference. Consequently, the temperature condition in the supply line, which exists during the operation of the yarn nozzle, is also maintained, when the latter is opened. Another consequence thereof is that, when the yarn nozzle is opened and the control of the temperature in the expansion chamber is again switched, the temperature in the expansion chamber approximates with a very close tolerance the temperature in the supply line and, consequently, assumes again substantially the same value as in the preceding operating phase. Thus, it is achieved that while the yarn nozzle is open, the operating condition of the supply line is maintained in the state in which it remained during the preceding operating phase, and that this state represents then again the reference for the new adjustment of the temperature in the expansion chamber during the next operating phase. In this manner, it is ensured that the operating conditions of successive operating phases substantially correspond to each other.

The automation of the yarn nozzle may also include provision for the automatic actuation of the valve. Thus, for example, the handle which is used to release the one nozzle section from the other, can simultaneously serve to actuate the valve, which disengages the supply line from the yarn nozzle and connects it to the exhaust line.

It should be emphasized that the provision of a throttle in the exhaust line is also useful and advantageous inasmuch as it completely avoids that the yarn nozzle, the operator and the surroundings are exposed to the hot air, when the nozzle is opened. It is easily possible to have the exhaust line terminate at a large distance from the yarn nozzle or the texturing machine depending on the accumulated volume of hot air.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
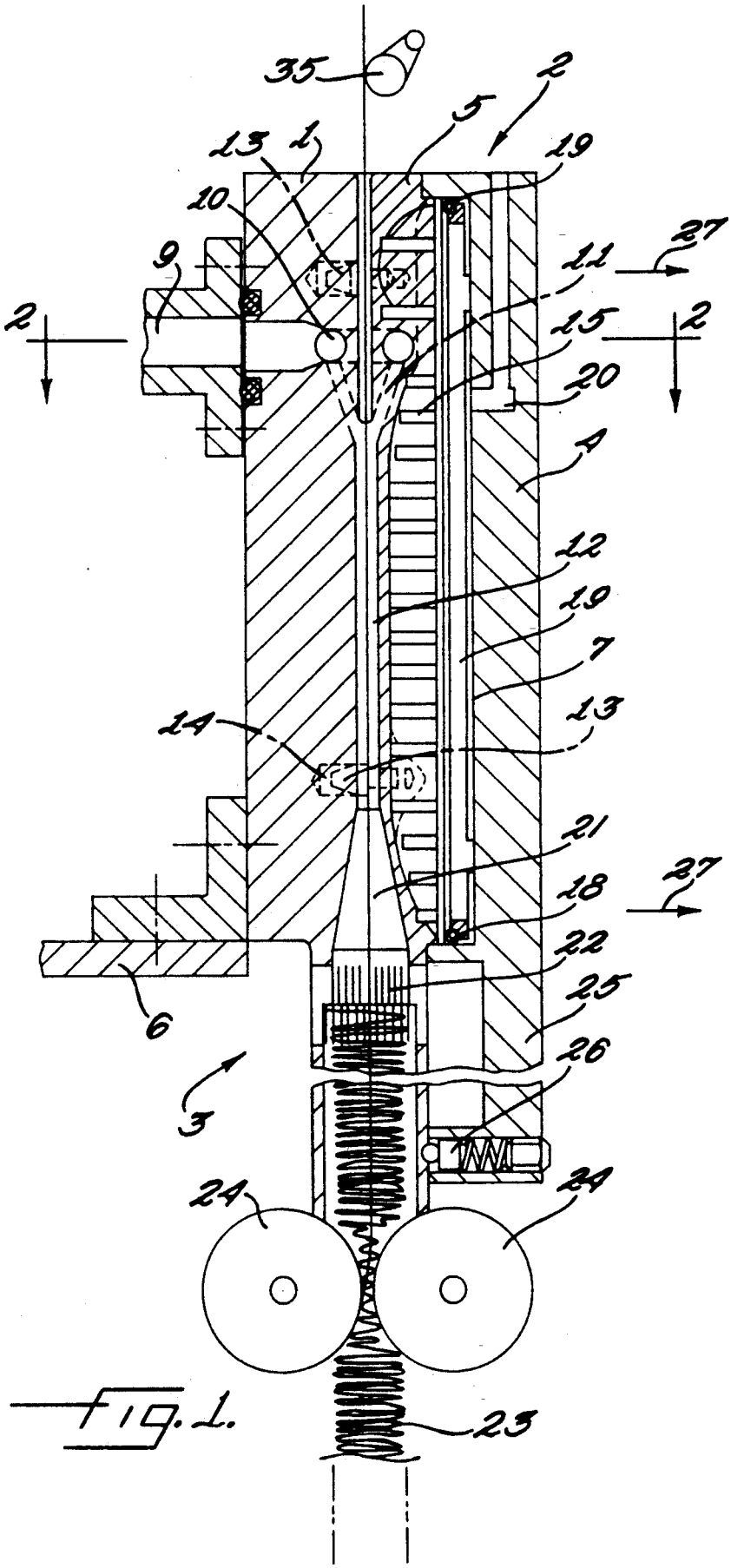
FIG. 1 is an axial sectional view of a yarn texturing nozzle in accordance with the invention.
Figure 2:
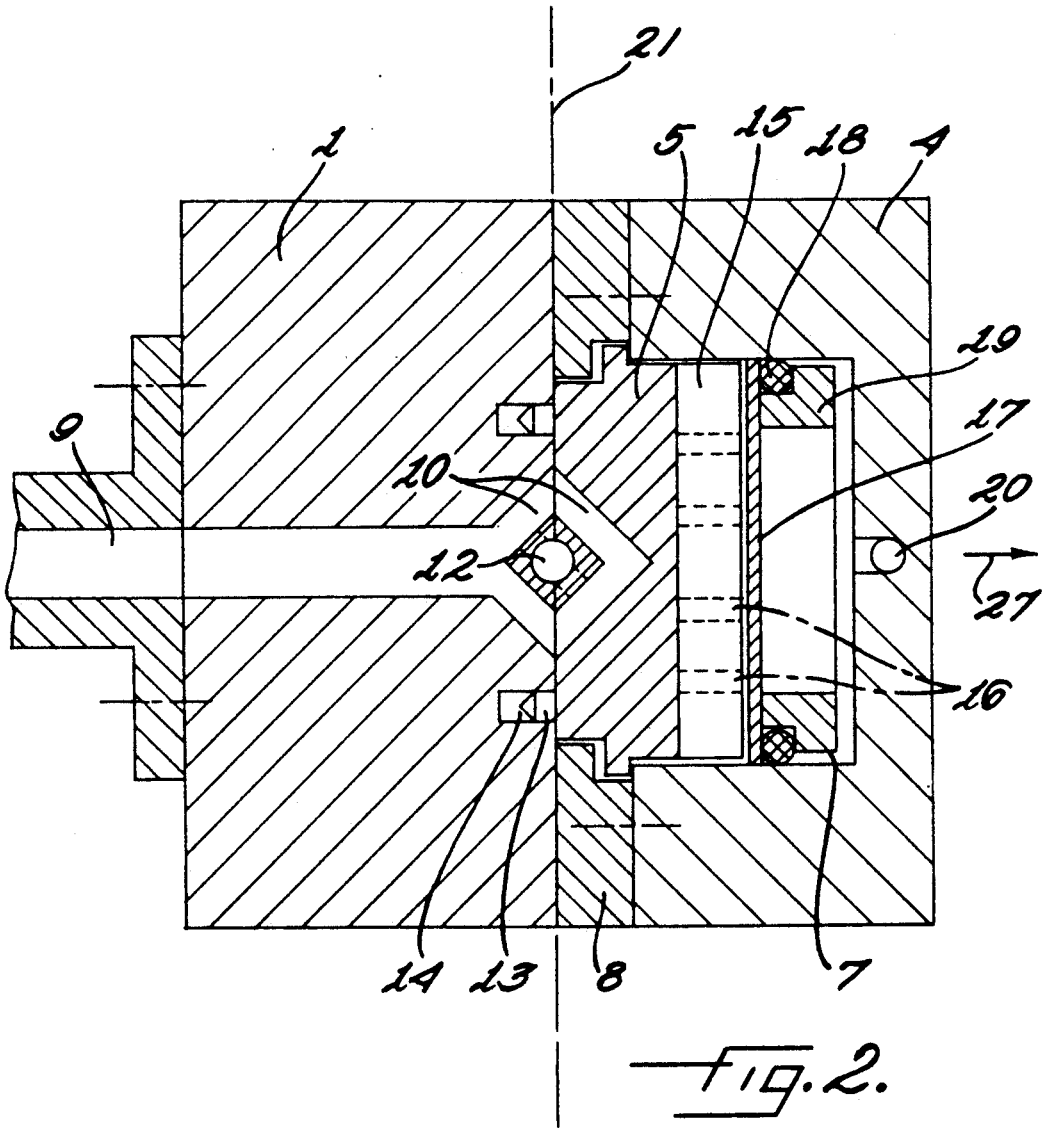
FIG. 2 is an enlarged cross sectional view of the yarn nozzle taken substantially along the line 2—2 of FIG. 1.

FIGS. 1 and 2 and the subsequent description are in part taken from EP-A 256,448, and U.S. Pat. No. 4,829,640, the disclosures of which are expressly incorporated herein by reference.

The texturing nozzle comprises two rectangular sections 1 and 2 with a stuffer box 3 positioned downstream thereof. The texturing nozzle and the stuffer box 3 are divided along a longitudinal plane 21. The nozzle section 1 shown on the left of FIG. 1 with the half of the stuffer box 3 attached thereto is mounted on the machine frame 6. The nozzle section 2 and its associated half of the stuffer box 3 are movable perpendicularly to the separating plane. The second nozzle section 2 comprises a guide member 4 and a piston 5. Formed into the guide member 4 is an elongate, cylindrical cavity 7. The piston 5 is fitted into this cylindrical cavity 7 in such a manner that it is movable in longitudinal direction. The movement of the piston relative to the guide member 4 is limited by a holder 8, which extends over the lateral projections of the piston. Formed into the back side of the piston are transverse grooves 15. The transverse grooves follow each other so closely that a desired flexibility of the piston is obtained in the longitudinal direction. In addition to the transverse grooves 15, it is possible to provide also longitudinal grooves 16 in the back side of the piston, so that the piston exhibits also a desired flexibility in the transverse direction.

On its back side directed into the cylindrical cavity 7, the piston is provided with a diaphragm 17, which is flexible. The shape of the diaphragm is adapted to the shape of the cylindrical cavity 7. The corner extending between the diaphragm 17 and the walls of the cavity 7 is sealed by a frame-shaped gasket 18. The gasket 18 is held in its position by a retaining frame 19, which is also adapted, with a greater tolerance, to the cross section of the cavity 7. The frame 19 has on one of its circumferential corners a groove, notch or the like, into which the frame-shaped gasket 18 is inserted. However, the gasket 18 projects beyond the periphery of the frame 19 such that the gasket contacts both the walls of cavity 7 and the diaphragm 17.

The cavity 7 is biased with a pressure medium supplied through a connecting duct 20. Preferably the medium is the heated medium which is also supplied to the texturing nozzle.

Figure 3:
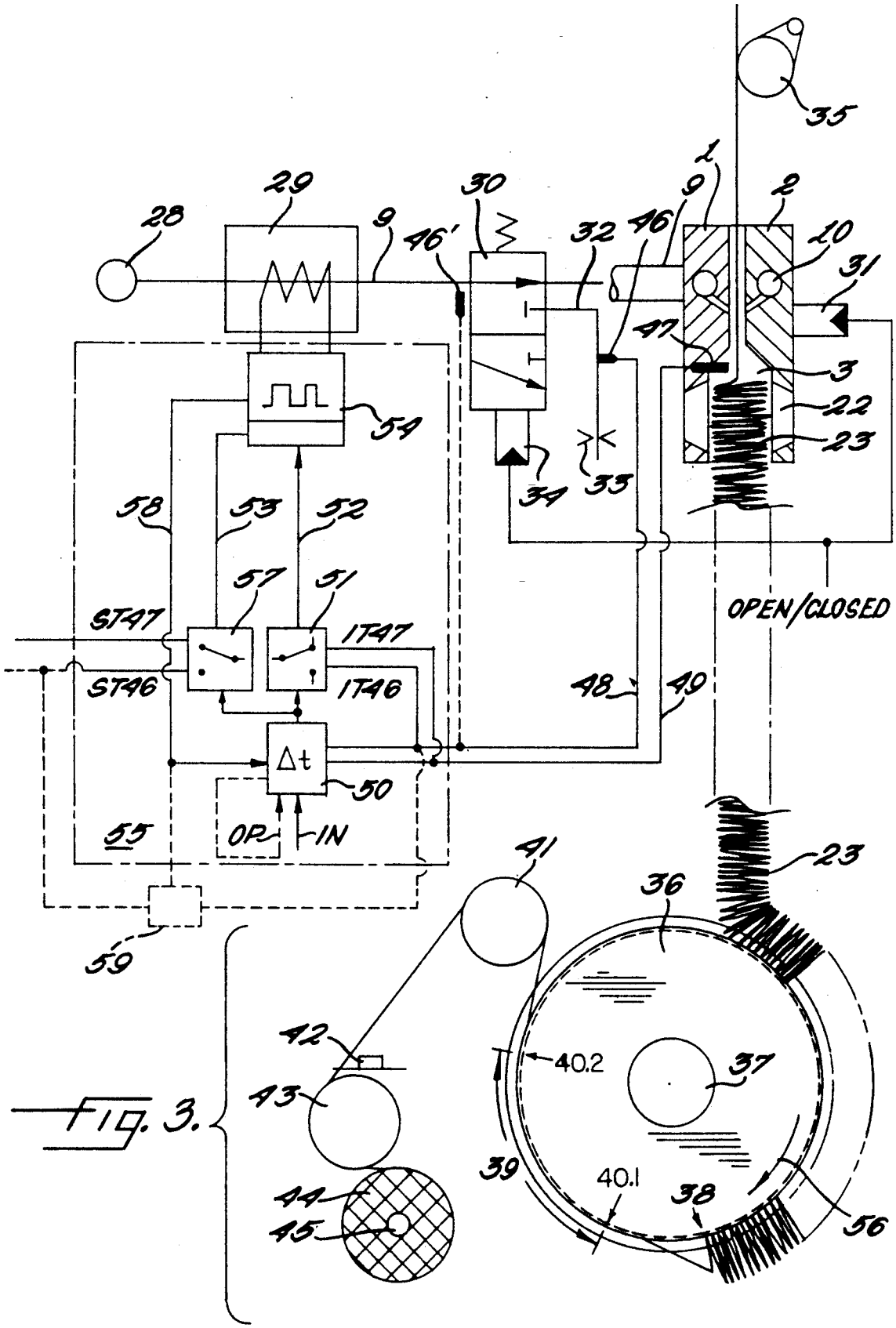
FIG. 3 is a schematic view of the yarn nozzle, the temperature sensors, and the heater control system of the present invention.

Both the first nozzle section 1 and the piston 5 are provided on their front side with a groove, which forms in the closed state (note FIG. 2) a duct 12 for the yarn. The yarn duct 12 receives hot air through a supply line 9, an annular duct 10 as well as tap bores 11. The openings of the annular duct 10 in the separating plane of both the first nozzle section 1 and the piston 5 are tightly superposed in the closed state, so that the hot air also flows into the piston. The tap bores terminate in the yarn duct 12 at an acute angle. The hot air flowing in the yarn duct exerts an impulse on the advancing yarn and simultaneously heats the yarn. As a result the yarn is compressed in the stuffer box 3 (expansion chamber) to a yarn plug. On the surface of the yarn plug, the hot air is able to escape through the slots 22 of the stuffer box 3. At the end of the stuffer box, the yarn plug 23 is advanced by delivery rolls 24 to a cooling drum 36 (FIG. 3).

The movable half of the stuffer box 3 is attached to the piston 5. Consequently, the guide member 4 is provided with a corresponding recess in the region where this half of the stuffer box passes through. The guide member 4 possesses an extension 25, which accommodates at its end a resilient support 26, which provides that in operation the two halves of the stuffer box 3 overlie each other sealably and free of movement.

It should be noted that the supply line 9 for the hot air and the connecting duct 20 are interconnected outside the texturing nozzle. However, it is also possible to connect the cavity 7 via the connecting duct 20 to a source of pressure, which is independent of the supply line 9 for the hot air. This permits the pressure which biases the piston 5 to be adjusted, independently of the pressure of the heated gaseous medium.

The means for opening and closing the nozzle are not illustrated. Such may include in particular cylinder-piston assemblies 31, which are indicated in FIG. 3, and which may be biased with pressure along with the cavity 7, so as to press the guide member 4 with the holder 8 firmly against the first nozzle section 1 and to push simultaneously the piston 5 into the separating plane 21. In any event, these cylinder-piston assemblies 31 are biased by an independent source of pressure. The following description proceeds from biasing the piston 5 by the heated gaseous medium.

For the purpose of threading a yarn in the present embodiment, the guide member 4 is moved away from the stationary first nozzle section in direction of arrow 27. In so doing, the supply of hot air to the connecting duct 20 and to the supply line 9 of the hot air is interrupted, as will be described below.

When the yarn is inserted into the region of the duct 12, the second section of the texturing apparatus is moved back, so that the first section 1 of the texturing nozzle and the piston 5 overlie in the separating plane 21. The centering pins 13 in the piston 5, which have a conical tip, as well as the centering bores 14 in the first section of the texturing nozzle ensure that the piston assumes in operation its position such that the two groove halves in the first half of the texturing nozzle and in the piston 5 overlap precisely in direction of the yarn duct 12. It is further ensured that also the openings of the annular duct 10 precisely overlie each other in the separating plane 21.

The connecting duct 20 is then connected with the heater. As a result, the cavity 7 is biased with pressure. The pressure medium first effects a sealing of the gasket 18 relative to the diaphragm 17 and the cavity wall. Further, the pressure medium pushes the piston 5 firmly against the separating plane 21 of the first texturing nozzle section 1.

The present invention will result from the following description of the embodiment of the texturing nozzle schematically illustrated in FIG. 3 and showing all elements decisive for the present invention. The yarn is supplied by a godet 35. As can be seen, the yarn duct 12 is substantially narrower than the expansion chamber 3. The forming yarn plug is delivered by wheels 24 not shown in FIG. 3 at a defined speed to the cooling drum 36, it being necessary to emphasize that the wheels 24 serve the purpose of influencing the exit speed for the yarn plug 23 from the expansion chamber 3 and keeping same constant. The cooling drum 36 is rotatingly driven at a slow speed corresponding to the exit speed of the yarn plug 23.

On its circumference, the cooling drum 36 possesses a groove with a perforated bottom. Except one air outlet end 37, the drum is closed impervious to air. The yarn plug 23 is guided over a partial range of the groove circumference. In so doing, an air current directed from the outside to the inside causes the yarn to adhere to the cooling drum and cools the yarn at the same time. Subsequently, the yarn is pulled out from the continuously advancing yarn plug 23 at a point of disentanglement 38. The position of the point of disentanglement is defined by the compactness of the yarn plug on the one hand and by the tension of the pulled-out yarn on the other, it being necessary to arrange the point of disentanglement 38 such that the yarn is still guided over a partial circumference of the cooling drum 36 or its grooves before it partially loops about a subsequent feed roll 41. This partial circumference between the point of contact 40.1 and the point of departure 40.2 will be described below as friction zone 39. After its looping about the feed roll 41, the yarn reaches a traversing mechanism 42 and a deflection roll 43, where it is wound to a package 44 which is held on a winding spindle 45.

The friction zone 39 results in a self-regulating effect. It is presumed that the surface speed of the cooling drum 36 corresponds to the speed of the yarn plug 23. Depending on the compression of the yarn in the plug 23, the yarn speed is several times higher. Consequently, frictional forces are operative on the yarn in the friction zone 39. As a result, the yarn tension between the point of disentanglement 38 and the point of contact 40.1 of the yarn on the surface of the cooling drum is less than the yarn tension between the point of departure 40.2 and the feed roll 41. As soon as the compression and compactness of the unraveling plug 23 lessen, the point of disentanglement 38 moves against the direction of rotation 56 of the cooling drum 36. Thus, however, the point of contact 40.1 moves likewise against the direction of rotation 56 with the result that the friction zone 39 becomes larger. As a result, the decrease of the yarn tension becomes greater in the friction zone 39, and the yarn tension lessens between the point of disentanglement 38 and the point of contact 40.1 Consequently, the point of disentanglement 38 and thus likewise the point of contact 40.1 move again in the direction of rotation 56.

What is endeavored is to reach an equilibrium. To this end it is necessary by experience that this shifting of the point of disentanglement 38 is kept within the narrowest possible limits. It has been found that too large shifting movements have a negative effect on the package buildup and the texturing quality.

This object has been accomplished in that the temperature sensor 47 which controls the heater control means 55 for the air heater 29, is positioned in the expansion chamber 3.

Referring again to FIG. 3, pressurized air from the source of compressed air 28 is heated in the heater 29. The compressed and heated air is then supplied via supply line 9 and valve 30 to the annular duct 10 of the nozzle. The heater 29 is controlled by a heater control means which is generally indicated at 55, and which includes a heater regulator in the form of a circuit breaker 54, which is connected via line 49 and suitable amplifiers with the temperature sensor 47. The duration of connection and disconnection of the circuit breaker 54 for the heater is controlled as a function of the measured temperature of sensor 47 so that the temperature on the sensor 47 in the expansion chamber remains substantially constant. It should be mentioned that in the place of the circuit breaker 54, it is also possible to have a continuous analog regulator.

It is found that with the arrangement of the temperature sensor 47 in the expansion chamber 3, the point of yarn disentanglement 38 barely moves, so that the previously described regulating process in the friction zone 39 proceeds within a very narrow range.

Along with the measurement of the temperature by sensor 47 in the expansion chamber, a regulation, which results in an always constant crimp, occurs as follows. As the plug 23 increases in length, the slots 22 of the stuffer box 3 are blocked. As a result, the pressure in the stuffer box increases and the expansion of the heated gaseous medium decreases. Due the increasing pressure in the stuffer box 3, the crimp is intensified. Since the decreasing expansion of the heated gaseous medium causes the temperature to rise, which is measured by sensor 47 in the stuffer box 3, the heating power of the circuit breaker 54, which is supplied to the heater 29, is decreased. Consequently, the temperature readjusts itself to the previously set desired value and accordingly decreases again, thereby also lessening the plasticization of the thermoplastic yarn and its crimp.

Thus, an equalization occurs automatically with regard to the intensity of the crimp. The arrangement of the temperature sensor 47 in the stuffer box 3 and the dependence of the energy supply to the heater 29 allow to automatically reverse the increasing intensity of the crimp due to the rising pressure by reducing the heating of the yarn and vice versa.

Furthermore, measures are provided which avoid having the surroundings of the nozzle and especially the operating personnel affected by the exiting hot air when the nozzle is opened. To this end, the valve 30 is provided, which is positioned in the supply line 9 between the heater 29 and the nozzle. The valve 30 is a two-way valve. In its normal position, the valve 30 opens the supply line 9 from the heater 29 to the yarn nozzle. In its other position, the heater is connected with an exhaust line 32. The exhaust line 32 terminates, via a throttle 33, at a suitable place in the open air. The throttle 33 is designed such that its air resistance for the hot air is substantially equal to the air resistance which the yarn nozzle has likewise in its operating condition.

The positioning of the valve 30 is effected by an adjusting unit 34. The adjusting unit 34 is connected with the locking mechanism 31 for the second, movable section of the yarn nozzle in the meaning of a synchronous actuation. As soon as the signal "yarn nozzle open" is sent through the common connecting line, the valve 30 is simultaneously brought to the position, in which the heater 29 is connected with the exhaust line 32, whereas the connection with the yarn nozzle 1 is closed. This ensures that the flow conditions remain substantially constant in the air heater 29.

However, at the same time it is also ensured that the heater 29 continues to operate with the heater control means 55 in its operating range, even while the yarn nozzle is opened and out of operation, and that its normal operation will not change, since the yarn sensor 47 is put out of operation and is disconnected at the same time.

A further regulation of the apparatus is illustrated in FIG. 3. To this end, a second yarn sensor 46 is provided in the supply line 9 between the heater 29 and the valve 30, or in the exhaust air duct 32. In the present embodiment, the last-mentioned alternative is shown. The first-mentioned alternative is shown in dashed lines, and the second temperature sensor is indicated at 46'.

Even when the yarn nozzle is closed, i.e. in operation, the temperature signals of the temperature sensors 46 and 47 are constantly supplied via lines 48 and 49 to the control means 55, which contains, among other things, a switching device (actual value switch) 51 and a switching device (set-point switch) 57 on the one hand, and a differential unit 50 on the other. In operation, a connection is made between the circuit breaker 54 and the temperature sensor 47. In the control circuit of the circuit breaker, the actual temperature IT47 is compared with the set temperature ST47.

It should be emphasized that the temperature on both sensors 46 and 47 is constantly measured also during the operation. In addition, devices are provided, which allow to acquire the considerable fluctuations of the temperature IT47 on the sensor 47, and which can be used to switch the actual value switch and the set-point switch 57. The differential unit serves as such a device.

During the operation, the difference between the temperatures IT46 and IT47 on the sensors 46 and 47 is formed in the differential unit 50, and compared with a set differential. This set differential is first input as empirical value IN.

When the circuit breaker 54 reaches its normal operating point, in which the temperature 47 remains substantially constant, a return signal is sent via line 58 to the differential unit 50. As a result, the temperature difference existing at this time between the actual values of the temperature sensors 46 and 47 is retained as a future set point in the place of the set point IN previously empirically input, and used for the further operation. During the following time, this set point can be actualized continuously or recurrently with a predetermined time delay as a result of comparing the temperature of the sensors 46, 47.

When the temperature difference exceeds this set point by more than an allowed measure, and when this condition continues for a certain predetermined period of time, a switching signal is supplied to the switches 51, 57. The actual value switch 51 and the set-point switch 57 are then switched simultaneously in the meaning that the control circuit of the circuit breaker 54 is connected with the temperature sensor 46 and with the set-point input ST46. This increased temperature difference will occur, as soon as the texturing nozzle is opened, because the temperature on sensor 47 will drop as a result of increased expansion.

However, it should be emphasized that the sensor 47 continues to measure the temperature even when the yarn nozzle is opened.

Thus, the switches 51 and 57 allow to connect alternately the lines 48 or 49 of the two temperature sensors 46 or 47 for the actual temperature values IT46, IT47, via lines 53, with the control circuit of the circuit breaker 54. Thus, when the yarn nozzle is open, the supply of energy to the heater 29 is adapted in such a manner that the temperature on the sensor 46 in the exhaust duct 32 remains constant. Since the rating of the throttle resistance of valve 30 ensures at the same time that the volume of the air throughput does not change substantially, the supply of energy to the heater 29 remains likewise substantially constant.

When the nozzle is closed, the temperature on the sensor 47 in the expansion chamber 3 rises again, since the expansion decreases and the pressure in the expansion chamber 3 increases. Also this temperature jump may be used for reversing the set-point switch 57 and the actual value switch 51. The temperature jump is again acquired by the formation and acquisition of the difference of the temperatures IT46 and IT47, because the temperature difference, which is measured on the sensors 46 and 47, decreases. As soon as the difference falls below the predetermined set difference IN or OP, the switches 51, 57 reverse in the meaning that the temperature sensor 47 and set-point input ST47 are again connected with the control circuit of circuit breaker 54. Thus, when the yarn nozzle is opened and closed, the following procedure occurs: when the nozzle is to be opened, the locking mechanism 31 is first actuated in the direction of opening, and the valve 30 is actuated at the same time. By actuating the valve 30, the heater is connected with the exhaust line 32. As a result of opening the nozzle 2, the temperature on sensor 47 in the expansion chamber 3 drops, and the temperature difference which is input as set point, is exceeded by more than an allowed extent. The set point and actual value are reversed. Thus, the heater 29 is now controlled as a function of the temperature measured on sensor 46 in such a manner that the temperature remains substantially constant.

This set point ST46 corresponds to the temperature, which empirically exists in the supply line 9 during operation and is input by hand. However, the set point ST46 can also be determined in the continuous operation of the nozzle and be stored. To this end, the current value IT46 measured on the temperature sensor 46 is constantly entered into the reference input unit 59 and stored therein as a reference value, as soon as the circuit breaker 54 signals via line 58 that the heater 29 has reached its stable operating condition. The reference value is thereafter continuously fed to switch 57 via the input line of the set point ST46. This allows to maintain the operating condition of also line 9, while the operation is interrupted. However, the linking of the reversal with the operating temperature difference between the sensors 46 and 47 allows to accomplish that the temperature in the supply line 9 always follows the temperature in the expansion chamber 3 with a certain tolerance, and that the temperature condition in the supply line, which existed directly before or during the opening of the expansion chamber 3, is frozen, i.e., maintained at this tolerance. Thus, during the opening the state of the flow and the temperature is maintained in the supply line, while allowing a predetermined tolerance.

When the yarn is inserted and the nozzle is again closed, the valve 30 is reversed at the same time as the locking mechanism 31 engages. The nozzle is again connected with the heater 29 and supplied with hot air. As a result, the temperature on the sensor 47 rises again until the differential falls below the predetermined differential reference value. Both the measured value and the reference value are switched respectively by switching unit 51 and set point unit 57.

The condition of the heated medium in the expansion chamber 3 readjusts itself to the condition maintained during the preceding operating phase due to the close linking via the temperature difference delta T, since, as aforesaid, this operating condition has been frozen, i.e. maintained, in the supply line 9.

Figure 4:
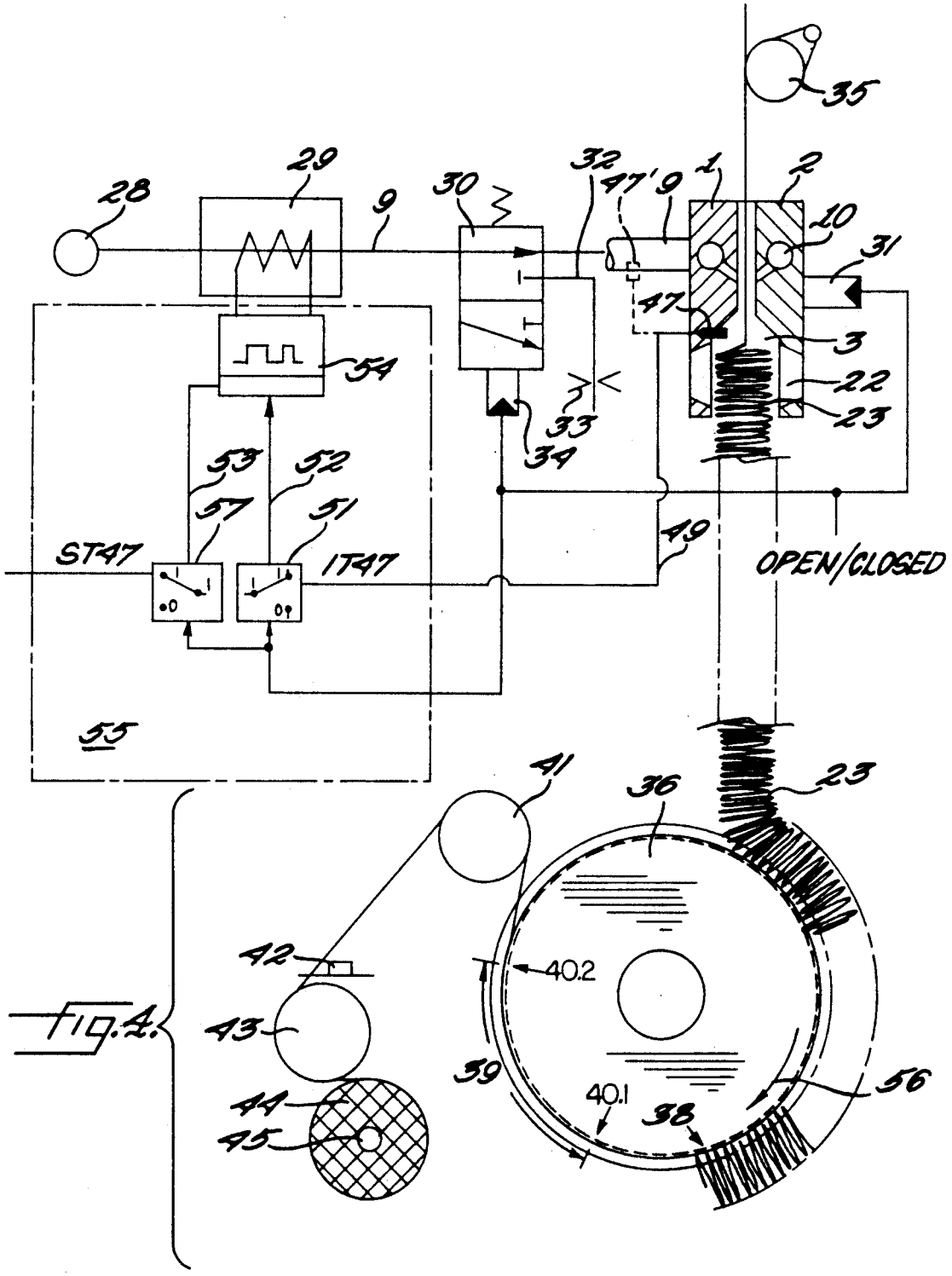
FIG. 4 is a schematic view of another embodiment of the present invention and which utilizes a single temperature sensor.

In the embodiment of FIG. 4, no further regulation occurs, when the yarn nozzle is opened. Consequently, only a single temperature sensor 47 is needed for the yarn nozzle. However, it should be expressly noted that, in this embodiment, it is not absolutely necessary to arrange this temperature sensor in the expansion chamber 3. Rather, it can also be arranged in the supply line 9 between the valve 30 and the nozzle 1, or before the valve. Note to this end the temperature sensor 47' of FIG. 4, which is shown in dashed lines and represents an alternative.

The temperature signal of the temperature sensor 47 is constantly supplied, via line 49, to the control means 55, when the yarn nozzle is closed. The control means 55 includes, among other things, a switching element (actual value switch 57) and a circuit breaker 54 with a regulating circuit. The latter receives, via switching element 51 and line 52, the actual value IT47 of the temperature, which is constantly measured on the temperature sensor 47. The regulating circuit of the circuit breaker 54 is supplied, via switching element 57 and line 53 with the set-point value of the temperature ST47. In the regulating circuit of the circuit breaker, the actual temperature IT47 is compared with the set-point temperature ST47. As a function of the difference, the circuit breaker 54 is controlled such that the measured temperature IT47 remains constant during the operation.

At the same time as the yarn nozzle is opened, the valve 30 is reversed by means of an actuating element, such as a magnet 34. As a result, the heater 29 is connected, via line 9, with the exhaust line 32 and the throttle 33. As previously described, the throttle 33 is adjusted in such a manner that its resistance corresponds substantially to that of the yarn nozzle in operation. Consequently, the volume of the air or vapor, which flows through the heater 29, remains constant. At the same time as the yarn nozzle is opened and the valve 30 is reversed, the actual value switch 51 and the set-point switch 57 switch to their respective zero setting. Therefore, the regulation in the regulating circuit of the circuit breaker 54 discontinues. Instead, by a corresponding switching of the regulating circuit, the circuit breaker 54 is held in the operating position, which was previously determined and stored while the yarn nozzle is closed. Thus, the circuit breaker 54 does not change its operating position as a result of opening the yarn nozzle. Consequently, the energy supply to the heater 29 remains unchanged, when the nozzle is opened. Since the throughput flow rate of the heating medium also remains unchanged, the temperature does not change either.

When the yarn nozzle is closed, the valve 30 reverses automatically and likewise the switching elements 51 and 57. Consequently, the heater is again connected with the yarn nozzle. At the same time, the regulating circuit of the circuit breaker 54 receives again both the measured actual value of the temperature IT47 and the set-point value of the temperature ST47. Consequently, a regulation occurs again in the meaning that the temperature on sensor 47 remains constant.

In the drawings and specification, there has been set forth preferred embodiments of the invention, and although specific terms are employed, they are used in a generic and descriptive sense only and not for purposes of limitation.

We claim:

1. An apparatus for texturing an advancing yarn with a pressurized heating fluid such as hot air, and comprising a nozzle including a duct through which the yarn is to advance at high speed from an inlet end to an outlet end, passageway means for conducting a pressurized heating fluid into said duct during operation of said apparatus, and a perforated stuffer box disposed adjacent the outlet end of said yarn duct for receiving and forming a compressed plug from the advancing yarn exiting from said duct, and heating means including a temperature sensor disposed in said stuffer box for maintaining the temperature of the heating fluid at a predetermined level.

2. The apparatus as defined in claim 1 further comprising a heating fluid supply line connected to said passageway means of said nozzle, and wherein said heating means further comprises a heater disposed in said supply line, and heater control means for controlling the output of said heater in response to a signal from said temperature sensor.

3. The apparatus as defined in claim 2 wherein said nozzle comprises two sections which are moveable with respect to each other and so as to define an operating position of said nozzle wherein said duct is laterally closed, and a non-operating position of said nozzle wherein said duct is laterally open to facilitate insertion of a yarn into said duct.

4. The apparatus as defined in claim 3 further comprising a valve in said supply line between said heater and said nozzle, said valve being moveable between a first position wherein the supply line is open to said nozzle and a second position wherein said supply line is open to an exhaust line, and means for moving said valve to said first position when said nozzle is in said operating position, and for moving said valve to said second position when said nozzle is in said non-operating position.

5. The apparatus as defined in claim 4 further comprising a second temperature sensor positioned in said supply line upstream of said valve or in said exhaust line, and said heater control means further comprising heater regulating means for controlling the output of said heater, and switch means for operatively connecting said first mentioned temperature sensor to said heater regulating means when said nozzle is in said operating position, and for operatively connecting said second temperature sensor to said heater regulating means when said nozzle is in said non-operating position.

6. The apparatus as defined in claim 5 wherein said switch means includes means for monitoring the temperature indicated by said first temperature sensor, and for (1) switching from said first sensor to said second sensor whenever the temperature of said first sensor drops below a predetermined value, and (2) switching from said second sensor to said first sensor whenever the temperature of said first sensor rises above a predetermined value.

7. The apparatus as defined in claim 5 wherein said switch means includes means for monitoring the temperature difference between the indicated temperatures of the first and second sensors, and for (1) switching from said first sensor to said second sensor whenever the actual difference exceeds a predetermined difference, and (2) switching from said second sensor to said first sensor whenever the difference is less than a predetermined difference.

8. The apparatus as defined in claim 7 further comprising means for periodically establishing said predetermined differences based upon the actual temperature difference existing during operation of said apparatus.

9. The apparatus as defined in claim 4 further comprising a throttle in said exhaust line and which imparts resistance to the fluid flowing therethrough which is substantially equal to the resistance imparted by said nozzle during operation thereof, and such that the quantitative flow rate of the heating fluid through the heater remains substantially unchanged when said nozzle is in said operating position and said non-operating position.

10. The apparatus as defined in claim 1 further comprising a drum having a gas permeable surface and being rotatably mounted adjacent said stuffer box so as to tangentially receive the compressed plug formed in said stuffer box and form the same into spiral convolutions on said surface, and means for drawing a gas radially through said surface of said drum and the spiral convolutions formed thereon.

11. The apparatus as defined in claim 4 wherein said nozzle comprises two confronting sections which are separable along a separating plane extending along said duct, and wherein one of said nozzle sections includes a cavity confronting and opening in the direction of the other of said sections, with said cavity extending over a substantial portion of the length and width of the other of said nozzle sections, and further comprising means for introducing pressurized fluid into said cavity, and piston means mounted in said cavity for movement in response to the pressure of the fluid within said cavity into abutting relationship with the confronting surface of the other nozzle section.

12. An apparatus for texturing an advancing yarn with a pressurized heating fluid such as hot air, and comprising a nozzle including a duct through which the yarn is to advance at high speed from an inlet end to an outlet end, passageway means for conducting a pressurized heating fluid into said duct during operation of said apparatus, and a perforated stuffer box disposed adjacent the outlet end of said yarn duct for receiving and forming a compressed plug from the advancing yarn exiting from said duct, with said nozzle comprising two sections which are moveable with respect to each other and so as to define an operating position of said nozzle wherein said duct is laterally closed, and a non-operating position of said nozzle wherein said duct is laterally open to facilitate insertion of a yarn into said duct, a heating fluid supply line connected to said passageway means of said nozzle, valve means positioned in said supply line and moveable between a first position when said nozzle is in said operating position and wherein said supply line is open to said nozzle, and a second position when said nozzle is in said non-operating position and wherein said supply line is open to the atmosphere through an exhaust line, heating means for maintaining the temperature of the heating fluid at a predetermined level, and comprising a heater disposed in said supply line, and heater regulating means for controlling the output of said heater in response to an input signal, a first temperature sensor positioned in said nozzle, a second temperature sensor positioned in said supply line upstream of said valve or in said exhaust line, and switch means for operatively connecting said first temperature sensor to said heater regulating means to provide said input signal when said nozzle is in said operating position, and for operatively connecting said second temperature sensor to said heater regulating means to provide said input signal when said nozzle is in said non-operating position.

13. The apparatus as defined in claim 12 further comprising a throttle in said exhaust line of said valve means and which imparts resistance to the fluid flowing therethrough which is substantially equal to the resistance imparted by said nozzle during operation thereof, and such that the quantitative flow rate of the heating fluid through the heater remains substantially unchanged when said nozzle is in said operating position and said non-operating position.

14. The apparatus as defined in claim 13 wherein said stuffer box has a larger cross section than said yarn duct, and said first temperature sensor is positioned in said stuffer box of said nozzle.

15. An apparatus for texturing an advancing yarn with a heating fluid such as hot air, and comprising a nozzle including a duct through which the yarn is to advance at high speed from an inlet end to an outlet end, passageway means for conducting a heating fluid into said duct during operation of said apparatus, with said nozzle comprising two sections which are moveable with respect to each other and so as to define an operating position of said nozzle wherein said duct is laterally closed, and a non-operating position of said nozzle wherein said duct is laterally open to facilitate insertion of a yarn into said duct, a heating fluid supply line connected to said passageway means of said nozzle, a valve positioned in said supply line and being moveable between a first position wherein said supply line is open to said nozzle and a second position wherein said supply line is open to the atmosphere through an exhaust line having a throttle therein, with said throttle having a resistance to the fluid flowing therethrough which is substantially equal to the resistance imparted by the nozzle during operation thereof, heating means positioned in said supply line, and control means for maintaining the output of said heating means substantially constant when said nozzle is moved between said operating and non-operating positions, whereby the quantitative flow rate of the heating fluid and the temperature of the heating fluid each may be maintained substantially the same when the nozzle is in said operating position and said non-operating position.

16. The apparatus as defined in claim 15 wherein said control means comprises first control means operative when said nozzle is in said operating position for controlling the output of said heating means so as to maintain the heating fluid at a predetermined temperature, and second control means operative when said nozzle is moved to said non-operating position for maintaining the output of said heater substantially equal to that which it had when said nozzle was in said operating position.

17. The apparatus as defined in claim 16 wherein said heating means comprises a heater, and heater regulating means for controlling the output of said heater in response to a input signal.

18. The apparatus as defined in claim 17 wherein said first control means comprises a temperature sensor positioned in said nozzle or in said heating fluid supply line and which provides said input signal to said heater regulating means when said nozzle is in said operating position.

19. The apparatus as defined in claim 18 wherein said second control means comprises circuit memory means for storing the value of said input signal from said temperature sensor when said nozzle is in said operating position and providing the same as the input signal to said heater regulating means when said nozzle is in said non-operating position

20. The apparatus as defined in claim 15 wherein said nozzle further comprises a perforated stuffer box disposed adjacent the outlet end of said yarn duct for receiving and forming a compressed plug from the advancing yarn exiting from said duct.

* * * * *